United States Patent [19]

O'Halloran et al.

[11] Patent Number: 4,634,022

[45] Date of Patent: Jan. 6, 1987

[54] FIXTURE FOR BAG-TYPE LIQUID DISPENSER

[76] Inventors: P. Joseph O'Halloran, 541 Clinton Ave., Wyckoff, N.J. 07481; Robert H. Laauwe, 237 Green Ridge Rd., Franklin Lakes, N.J. 07417; Stanley L. Roggenburg, Jr., 70 St. James Pl., Staten Island, N.Y. 10304; Michael E. Tully, 69 Bentley St., Staten Island, N.Y. 10307

[21] Appl. No.: 738,660

[22] Filed: May 28, 1985

[51] Int. Cl.[4] ..... B65D 35/28

[52] U.S. Cl. ..... 222/95; 222/181; 222/214

[58] Field of Search ..... 222/105, 103, 95, 96, 222/212, 214, 207, 181, 182, 185, 494, 449, 450, 83, 81; 383/906, 104

[56] References Cited

U.S. PATENT DOCUMENTS

| | | | |
|---|---|---|---|
| 2,554,570 | 5/1951 | Harvey | 222/185 |
| 3,926,347 | 12/1975 | Low et al. | 222/214 |
| 4,130,224 | 12/1978 | Norman et al. | 222/214 |
| 4,324,348 | 4/1982 | Johnson et al. | 222/181 |
| 4,429,812 | 2/1984 | Steiner et al. | 222/181 |
| 4,463,876 | 8/1984 | Swallert | 222/185 |
| 4,570,827 | 2/1986 | Roggenburg et al. | 222/95 |

FOREIGN PATENT DOCUMENTS

| | | | |
|---|---|---|---|
| 3101020 | 12/1981 | Fed. Rep. of Germany | 222/207 |

*Primary Examiner*—Charles A. Marmor
*Assistant Examiner*—Kenneth Noland
*Attorney, Agent, or Firm*—Kenyon & Kenyon

[57] ABSTRACT

A wall fixture containing a liquid dispenser, the fixture comprising a bracket having an upstanding plate from the bottom of which a shelf having a nozzle hole extends forwardly and a cover adapted to open and close in front of the plate and shelf, the dispenser comprising a flexible bag having front and back walls containing the liquid and having a main portion with its back wall suspended in front of the plate and a dispensing portion folded forwardly on the shelf so as to form a lower wall, the lower wall having a dispensing valve having a dispensing nozzle extending downwardly through the nozzle hole, and a depressible upper wall above the valve, the valve having an operator between the upper and lower walls and actuated by pressing the upper wall downwardly on the operator; the cover having a pressing arrangement for pressing a bulge in the bag's front wall and extending towards the bag's back wall at a position above the bag's dispensing portion and so as to form a passageway on at least one side of the bulge extending between the main and dispensing portions of the bag when the cover is closed.

8 Claims, 11 Drawing Figures

FIXTURE FOR BAG-TYPE LIQUID DISPENSER

Up to the present time there has not been an adequately satisfactory wall fixture for a liquid dispenser of the type containing a liquid, such as liquid or soft soap, in a flexible bag having front and back walls peripherally sealed together and forming a main or supply portion normally suspended upright or vertically. The bag walls also form a dispensing portion usually but not necessarily in the form of a tongue or tab, extending from the main portion and normally folded angularly forwardly relative to the bag's front wall. This dispensing portion has a dispensing valve in its back or lower wall. The valve has an externally extending dispensing nozzle extending downwardly when the bag's dispensing portion is folded forwardly, and an internal actuator, between or inside the bag walls, operated by pressing the front or upper wall of the dispensing portion against this actuator.

In the case of liquid soap and possibly for other liquids, this type of dispenser has the advantage that the soap can be hermetically sealed in the bag until the soap is dispensed. The valve can be made as a metering dispensing valve dispensing a predetermined charge of soap each time the front wall of the bag's dispensing portion is manually depressed. The hermetic sealing is of importance in the case of some soap and other liquid products exemplified by antiseptic soap used in hospitals.

To be commercially practical this type of dispenser requires a wall fixture capable of being produced inexpensively in large quantities, and which can support this type of dispenser in an operative manner for a long service life during which unused dispensers and exhausted dispensers are periodically installed and removed.

Basically, a fixture for this type of dispenser requires a back wall adapted to be fastened to a building wall, such as in a washroom, and a shelf extending forwardly from this back wall for supporting the forwardly folded dispensing portion, with means for suspending the bag on the back wall with its dispensing portion folded forwardly on the shelf, and the shelf must have a hole down through which the dispensing valve's nozzle can depend. Also there should be a cover or door covering the bag including its dispensing portion, provided with some kind of actuator for depressing the valve's operator via the bag's front or upper wall portion forming the dispensing portion of the bag.

There have been problems in connection with the design and construction of a satisfactory fixture. One problem was that the dispenser bag is made extremely flexible and when hung on a fixture's vertical wall with the dispensing portion folded forwardly on the shelf, the main portion of the bag bellows or bulges forwardly to an extent pinching off or reducing the supply of liquid from the bag's main portion to its dispensing portion, this being particularly true in the case of a fully loaded dispenser initially installed in the fixture.

A troublesome problem was the possibility that when servicing the fixture a dispenser might be installed when containing a liquid not intended for that fixture. For example, a dispenser containing antiseptic soap might be installed in a fixture in a public washroom, and a dispenser containing ordinary soap might be installed in a fixture in the surgeon's bathroom of a hospital. The dispensers all look alike excepting possibly for indicia printed on the bag wall.

Still another problem was in connection with providing the fixture's cover with a closing latch system provided with an actuator adequately inconspicuous to prevent possible opening of the cover and removal of the dispenser by unauthorized persons. At the same time this system had to be incorporated into the fixture's design adequately inexpensively while at the same time being reliable and easily operated.

For appearance and protection the fixture's cover when closed should cover not only the bag's main portion but also its forwardly folded dispensing portion. This introduced the problem of providing the fixture's cover with an externally accessible actuator providing some leverage for pressing the bag's front wall of the dispensing portion downwardly on the dispensing valve's actuator as required for dispensing a charge of soap. Such a device must be reliable but inexpensive.

An overall problem developed in connection with overcoming all of the foregoing problems by a construction that could be made substantially entirely from injection molded parts.

Briefly summarized, and with the foregoing in mind, the fixture of the present invention comprises a plastic injection molded bracket forming a back wall for the suspended main portion of the dispenser and a forwardly extending shelf on which the bag's dispensing portion is supported, the shelf having a vertical hole down through which the bag's dispensing valve nozzle can extend. An injection molded cover is hinged to the front of the bracket's shelf and has a centrally located indent or inwardly projecting portion which, when the cover is closed, presses against the central portion of the main portion of the dispenser bag when installed in the fixture. This bulges the bag inwardly slightly above the fold line between the bag's two portions, preventing the bag from bellying forwardly and closing off or reducing communication between the bag's main portion and its forwardly folded dispensing portion where the dispensing valve is located. On either side of the bag's inwardly pressed portion two relatively large vertical passageways are formed for feeding to the dispensing portion.

To prevent the installation of a dispenser containing a wrong soap or other liquid in a fixture for which it is not intended, the valve's nozzle and the fixture's hole in the shelf are shaped as by the provisions of ribs and slots in the respective parts so that only the valve's nozzle of a correct dispenser can be inserted in the shelf's hole of the proper fixture for which that dispenser should be supplied. In other words, the valve nozzle and hole are in effect coded so that only the valve nozzle of the proper dispenser will fit the hole.

The cover is hinged to the front edge of the bracket's shelf so the cover can swing downwardly and outwardly for installation and removal of the dispenser. To latch the cover closed a flat latch plate slidably extends vertically on the front face of the bracket's back wall, with an actuator extending downwardly through the shelf for relatively concealed access by an operator's finger. The top of the latch plate forms a latching engagement with the top of the cover and to keep the latch plate spring biased upwardly it has two laterally extending cantilever spring arms engaged by pins extending from the bracket's back wall. The top of the latch bracket forms a cross head from which two pins project forwardly and over which the usual two holes in the top of the bag type dispenser can be applied to suspend the bag. Each of the parts just mentioned are formed by a single injection molded plastic part.

A part of the cover is shaped to cover the forwardly folded dispensing portion of the dispenser bag and this part is formed with an opening closed by a dispenser valve actuator or push button entirely made as an injection molded plastic assembly and hinged on the cover at a location inwardly of the dispensing valve's actuator so as to provide some leverage when pressed downwardly. This assembly has a projection engaging the front wall of the bag above its dispensing portion and which is made tubular so as to close and seal the valve feeding opening when pressed downwardly. In this connection it is to be understood that a typical valve has its actuator in the form of an elastically flexible dome positioned between the bag walls forming the dispensing portion, this central hole feeding the dispensed liquid to the inside of the valve and requiring closing when depressing the dome to actuate the dispensing valve The downwardly projecting valve's dispensing nozzle is part of a check valve construction which opens when the dome is depressed with its hole closed, and closes when the dome is released and recovers.

The details of this new fixture are described below with the aid of the accompanying drawings in which.

Figure 4:
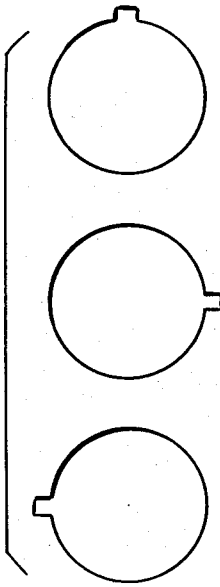
Figure 1:
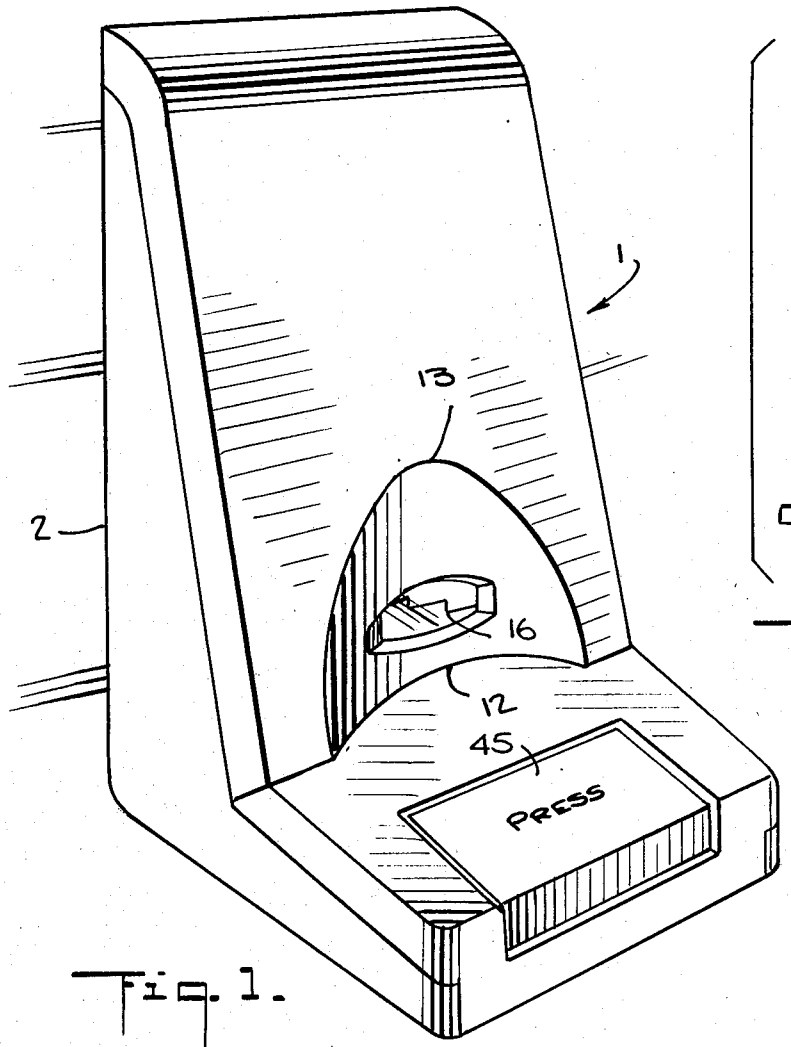
FIG. 1 is a perspective view showing the external appearance of the fixture.
Figure 5:
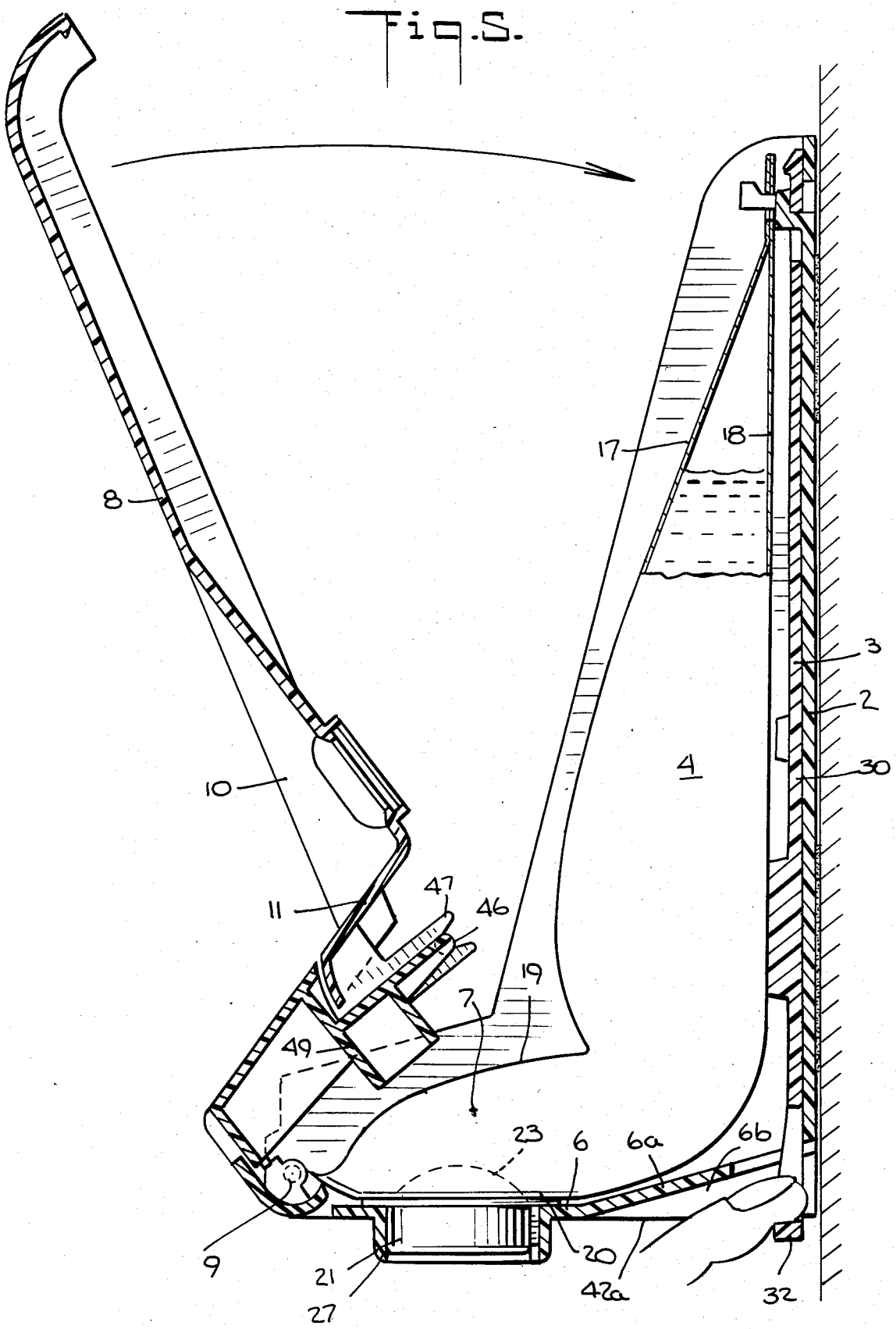
Figure 6:
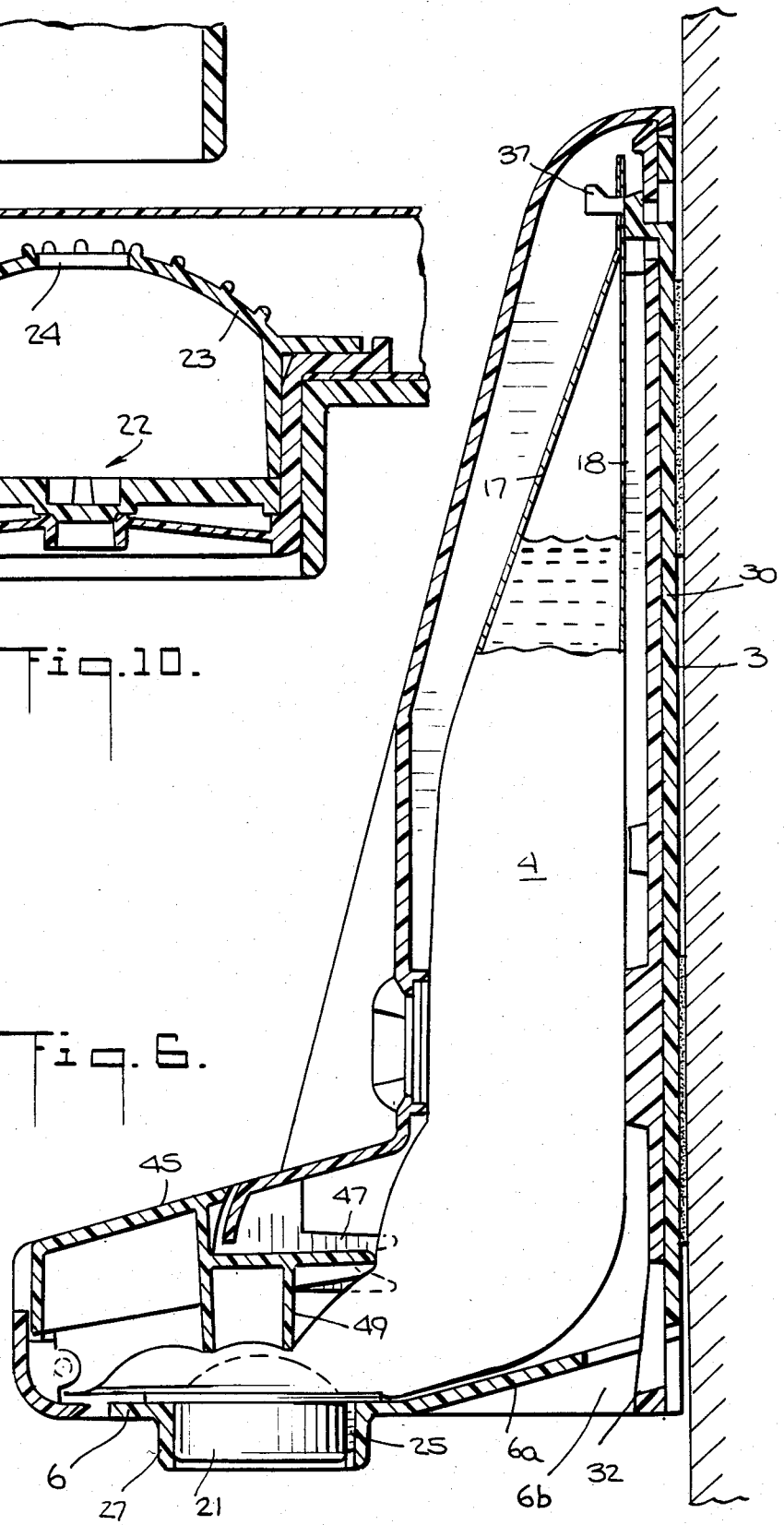
Figure 7:
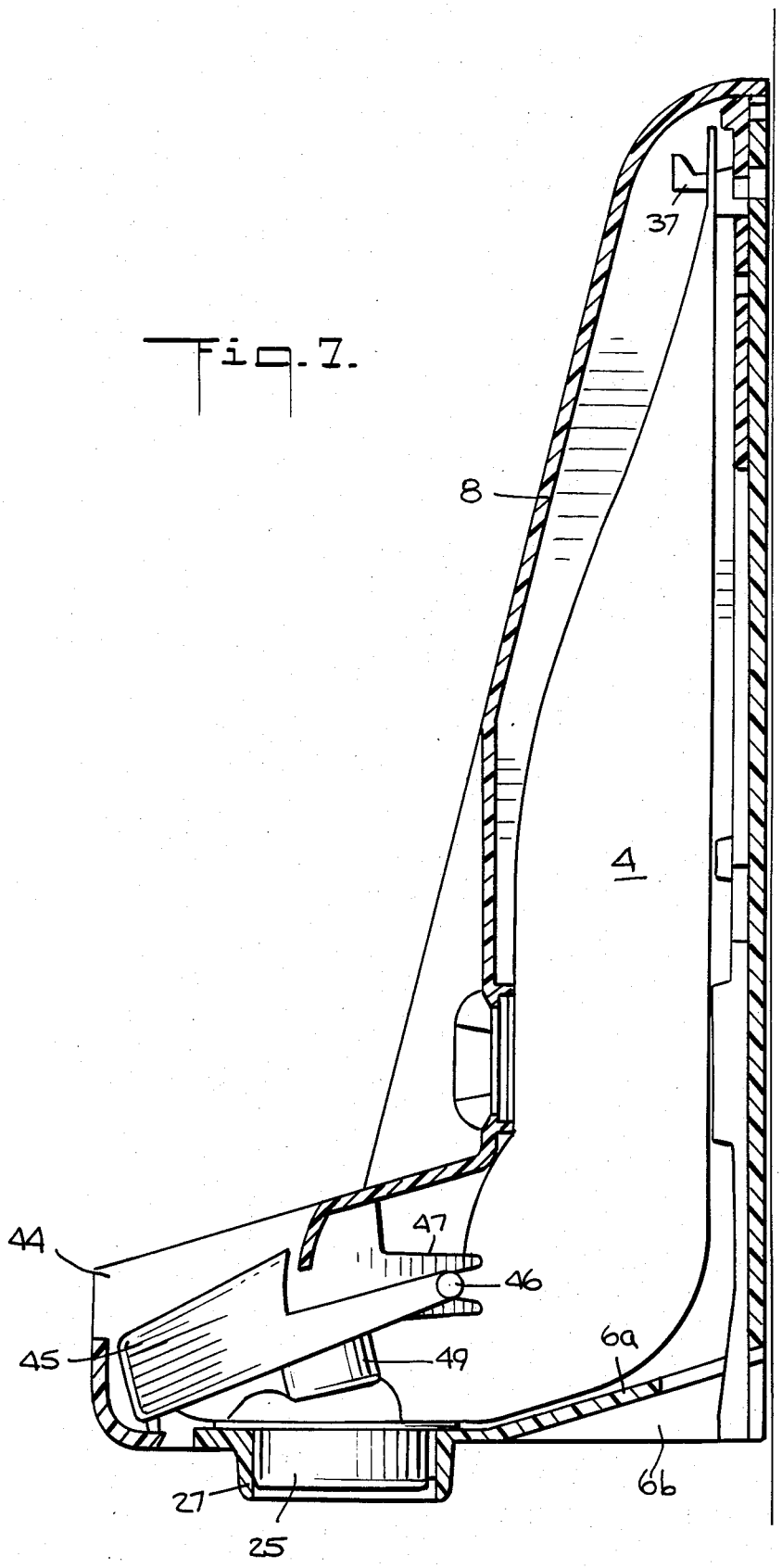
Figure 8:
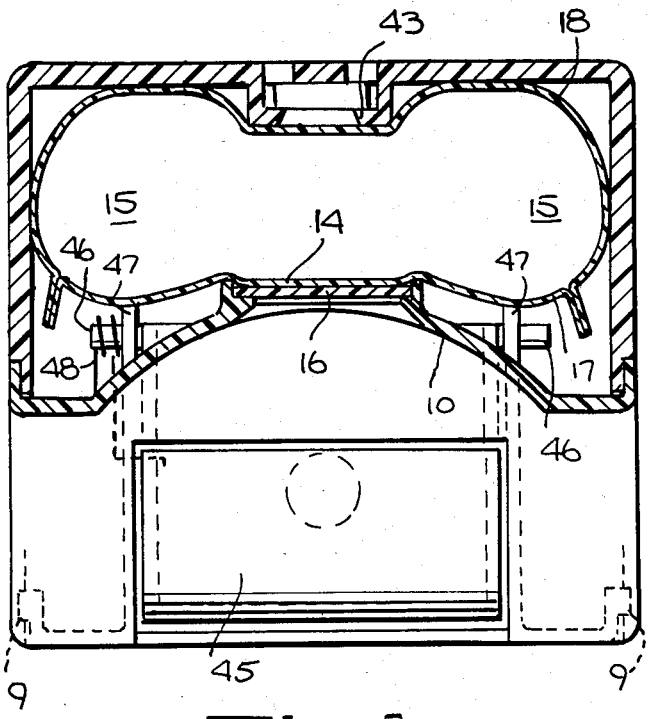
Figure 7A:
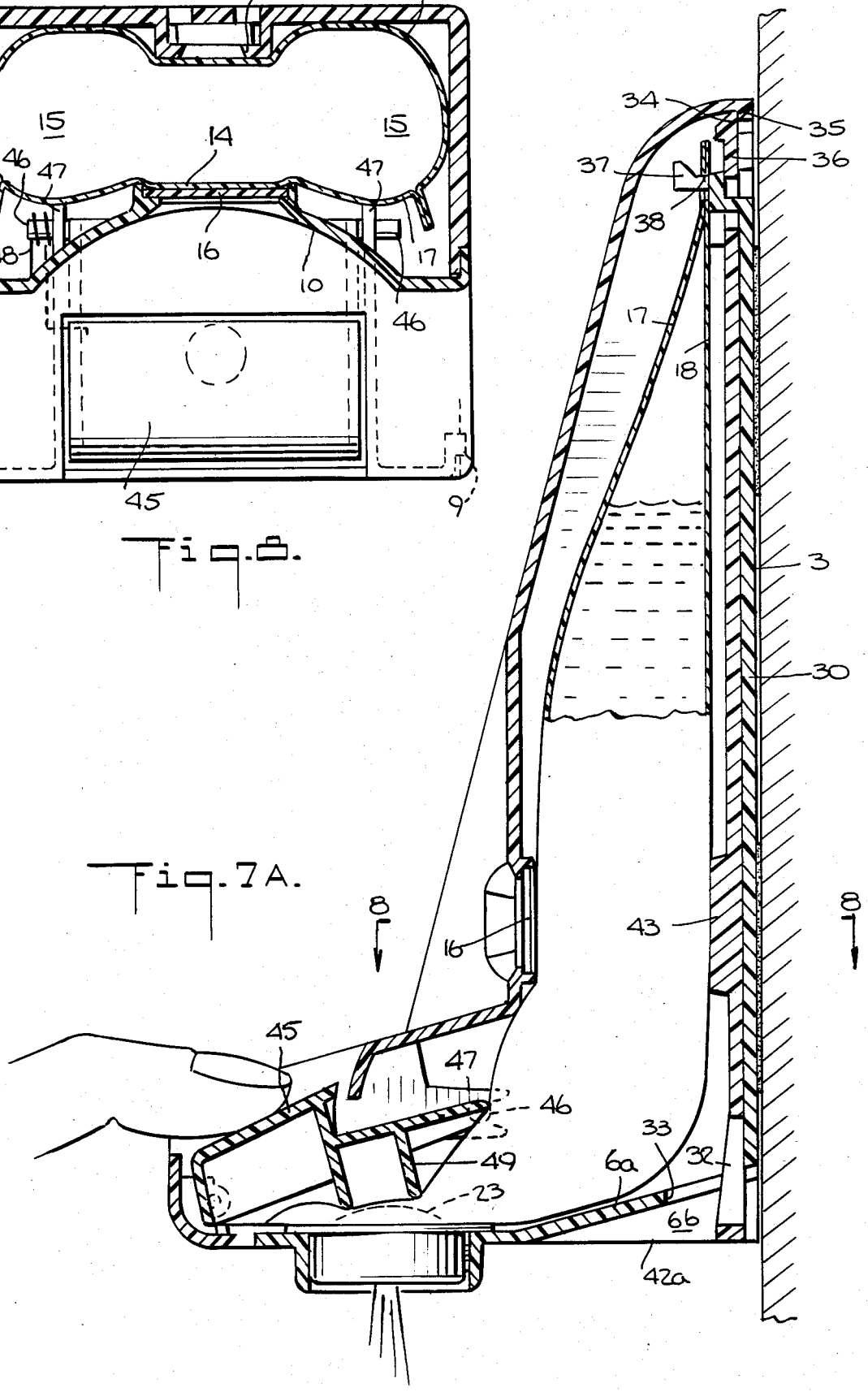

FIG. 4 schematically illustrates possible variations of the nozzle and hole shapes;

FIG. 5 is a vertical section showing the dispenser installed in the fixture and the fixture's cover swinging closed;

FIG. 6 is a vertical section showing the dispenser installed and the fixture's cover closed so that the fixture is ready for operation;

FIG. 7 is a vertical section taken on a different vertical plane from that of FIG. 6 and showing the dispenser valve actuator in its depressed condition, the major parts inside of the fixture being shown in elevation;

FIG. *7a* is like FIG. 6 but shows the dispenser valve actuator depressed so as to dispense the liquid;

FIG. 8 is a cross section taken on lines 8—8 in FIG. *7a;*

Figure 10:
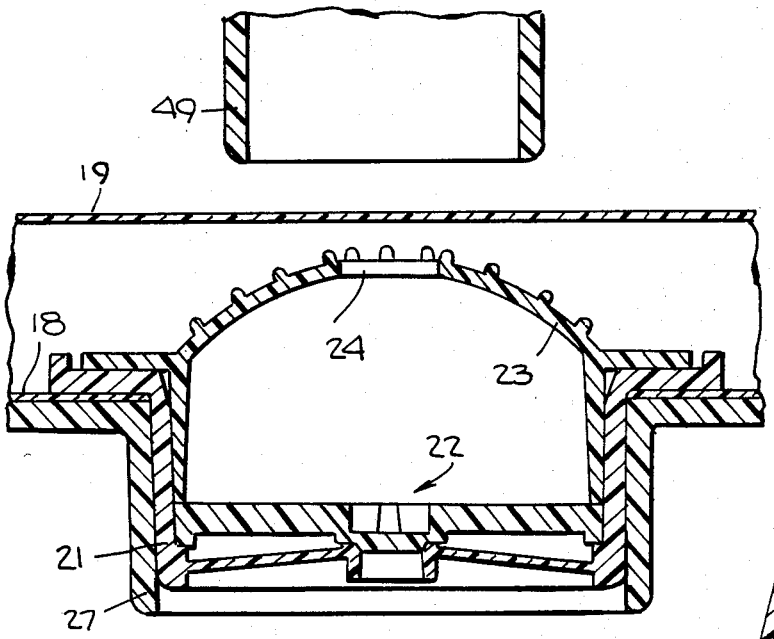
Figure 9:
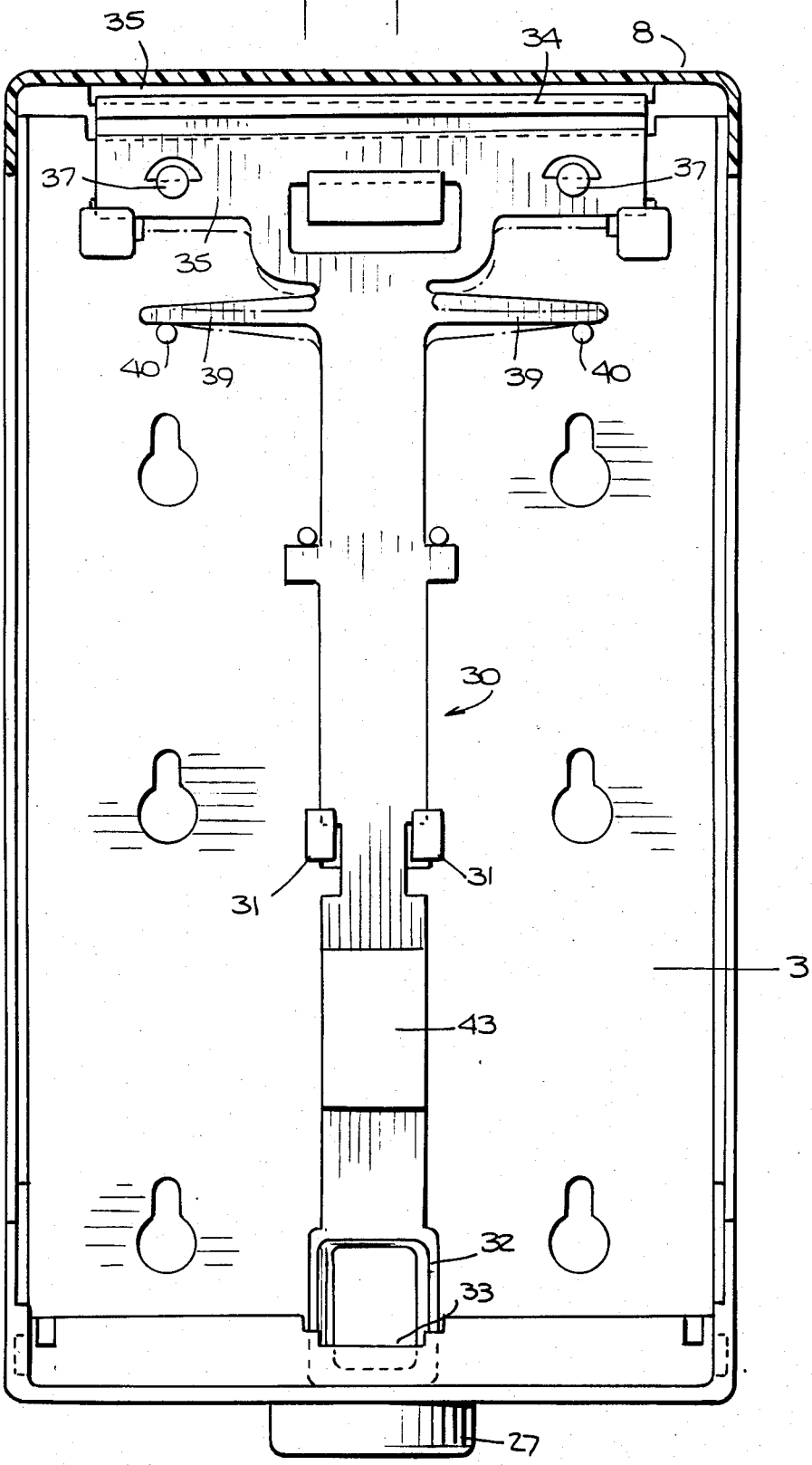

FIG. 9 is a front elevation view of the fixture's bracket with the cover removed; and FIG. 10 is a vertical cross section showing the construction of the dispenser's dispensing valve.

Figure 2:
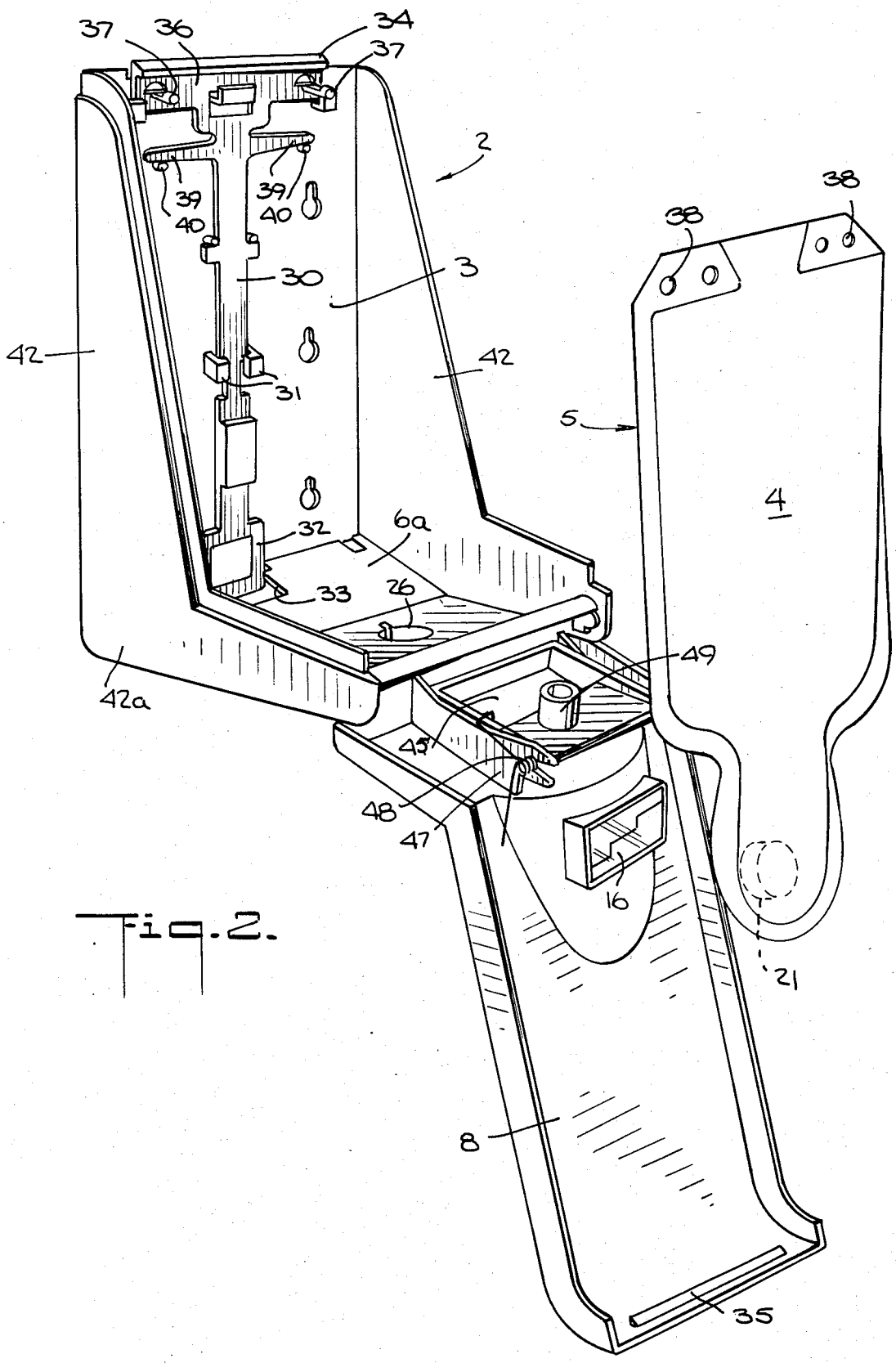
FIG. 2 is also a perspective view but shows the fixture with its cover opened, and beside it showing one of the liquid dispensers about to be installed in the fixture.

As illustrated by the above drawings, the fixture 1 comprises a plastic injection molded bracket 2 forming a back wall 3 for the suspended main portion 4 of the liquid dispenser 5 shown in perspective in FIG. 2. The bracket is shown with its forwardly extending shelf 6 and the dispenser bag's dispensing portion 7 folded forwardly and resting on the shelf 6.

The plastic injection molded cover 8 is hinged at 9 to the front edge of the shelf 7 and has the centrally located indent 10 which as shown particularly well by FIG. 8, bulges the bag's main portion 4 inwardly. The cover 8 has a forwardly extending flat portion 11 which covers the forwardly folded dispensing portion of the bag and which rests on the bracket's shelf 6, and the indent 10 extends upwardly from this flat portion 11 from a concavo-convex base 12 while converging to a top or blunt apex 13. This gives the indent 10 a smooth and generally rounded interior which presses the bag's main portion inwardly transversely centrally between its sides without damage to the bag's wall. This bulges the bag inwardly as shown at 14 in FIG. 8 and contributes to the formation in the dispenser's main portion of two side vertical conduits 15 which always remain open to feed the dispenser's liquid to its forwardly folded dispensing portion 7, when the cover is closed. At its central portion the indent 10 is provided with a glazed window 16 which presses flat against the bag's main portion and as the liquid in the dispenser bag approaches exhaustion, provides a visual warning that in the near future that dispenser will require replacement by an unused dispenser.

The dispenser bag is formed of flexible plastic, preferably transparent or translucent front and back walls 17 and 18 respectively with their edges side-seamed together so that the forwardly folded portion forms upper and lower walls 19 and 20 respectively, and it is in this lower wall that the dispensing valve illustrated by FIG. 10 is located. The illustrated form of dispensing valve is the subject of the Roggenburg and Laauwe U.S. Pat. No. 4,478,356.

The dispensing nozzle 21 extends downwardly from the folded portion of the bag and is in the form of a tubular housing for the valve's check valve 22 above which there is the elastically depressible dome 23 having a central inlet hole 24. The check valve 22 is normally closed and is forced open by the dispensed liquid which normally flows into the valve via the inlet hole 24, upon downward pressure on the bag's dispensing portion's upper wall causing its inside to contact the top of the dome 23, closing the inlet hole 24 and depressing the dome. This pressurizes the liquid so it forces the check valve 22 open, resulting in the dispensing of a metered charge of liquid.

Once the dispenser is filled with the liquid and the parts are sealed, the liquid is hermetically enclosed so that it is protected against contamination. This adapts this type of dispenser to the use of antiseptic liquid soap used in hospitals as well as to the normal liquid soap used in public washrooms.

Figure 3:
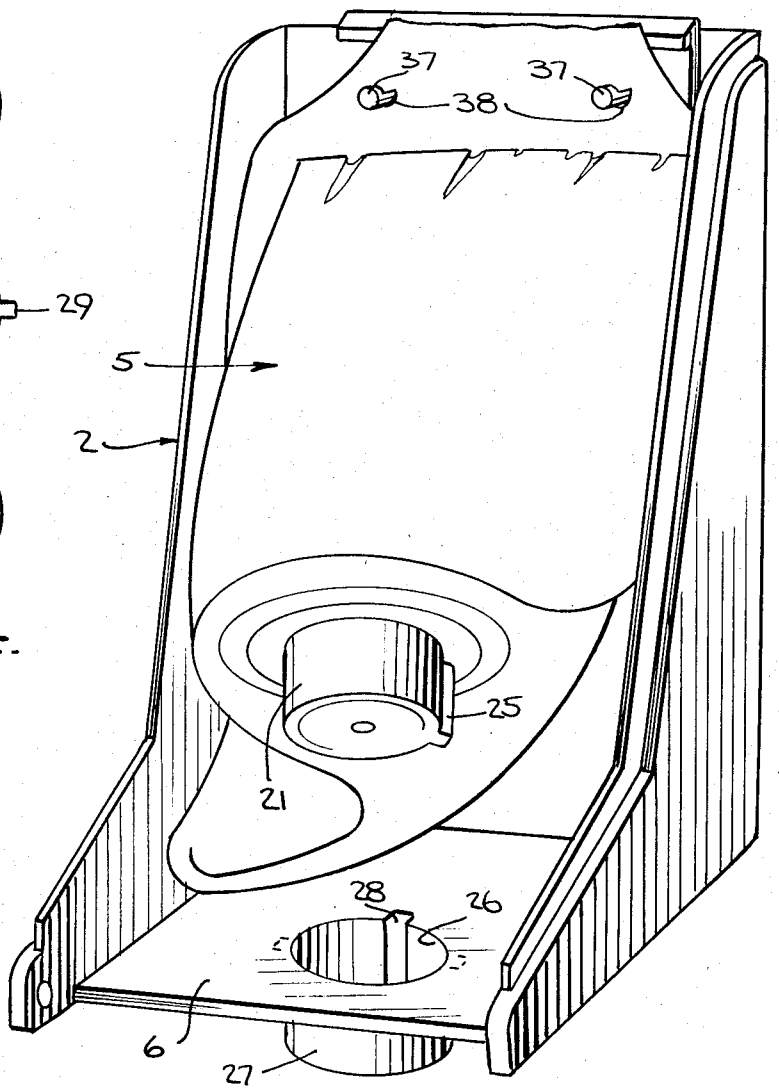
FIG. 3 is a perspective view showing the fixture with its cover removed so as to show the nozzle of the dispenser's valve and the hole in the shelf of the fixture's bracket, the valve and hole being respectively shaped so that only the nozzle illustrated fits the hole.

Therefore, as shown by FIG. 3 the dispensing nozzle 21 is preferably externally formed with an axially extending rib 25, the shelf 6 having its nozzle hole 26 formed with a downwardly depending collar 27 internally formed with a groove 28 fitted by the nozzle's rib 25. The nozzle 21 and its rib 25 form a sliding fit with the hole 26 and its collar 27, the rib 25 sliding freely in the groove 28.

Assuming the rib and groove are oriented or positioned as shown in FIG. 4, any other dispenser having a nozzle with a rib otherwise oriented circumferentially as suggested by the top and bottom representatives in FIG. 4, cannot be used with the fixture. An attempt to do so requires that the dispenser bag's nozzle be twisted rotatively to such a degree as to practically shut off the valve from the bag's contents and in any event making it very apparent that a wrong liquid dispenser is involved.

In the above way the nozzle in effect forms a key and the hole 26 and its collar 27 forms a keyhole. A fixture attendant is prevented or at least very discouraged from attempting to install a dispenser containing common soap in a fixture intended to dispense only antiseptic soap, for example.

Because the cover is hinged at 9 to the front edge of the bracket's shelf 6 it can swing forwardly and requires a latch to hold it in its closed position. If this latch is obviously exposed it would tempt washroom users to open the fixture and remove the liquid dispenser. It is preferable to have the latch operated by a reasonably concealed actuator.

This indicates that the latch actuator should be inconspicuously positioned beneath the fixture although latching at the top of the bracket with the top of the cover when closed.

To meet the above requirement a flat latch plate 30 slidably extends vertically on the front face of the bracket's back wall 3 which is formed with guides 31 slidably guiding the latch plate 30 at its middle part. The lower end of the latch bar is guided by having an actuator 32 in the form of a rectangular loop having its sides guided in a rectangular hole 33 formed in the back portion of the shelf 6, in which the actuator slides. The latch bar extends for the complete height of the back wall 3 and at its top forms a transversely extending latch 34 which latches with a latch part 35 formed on the inside of the top of the cover. This latch 34 is part of a crosshead 36 formed as an integral part of the latch plate 30, and pins 37 project forwardly from the ends of this crosshead, the dispenser 5 having holes 38 in the top of its main portion and through which the pins 37 are inserted when the dispenser is installed in the fixture, thus holding the main portion of the bag suspended with its back wall 18 against the fixture's wall 3 and on the flat latch bar 30. To spring bias the latch bar upwardly it has two laterally extending cantilever spring arms 39 with the bottoms of their ends engaged by pins 40 projecting forwardly from the back wall 3 of the fixture. A downward pull on the latch bar causes elastic deflection of the springs 39 and when the pull is released they force the latch bar to return upwardly.

The latch bar actuator 32, in the form of a rectangular loop, projects downwardly through the hole 33 in the shelf 6 so as to be accessible for finger operation. For concealment the shelf 6 inclines upwardly as at **6*a* from a horizontal portion through which the nozzle hole is formed, and the bracket 3 is formed with forwardly extending side walls 42 having portions 42*a* forming lower edges below the level of the inclined portion 6*a*. When inactive the latch bar's actuator 32 is above the level of the bottom edges of the bracket's wall 42*a* and the lower end of the shelf's inclined portion 6*a*, as can be seen in FIGS. 6 and 7 for example. A recess 6*b* is thus provided into which the fixture attendant can reach with his finger to pull the latch bar down by its actuator 32**. The actuator is normally concealed and unobvious.

The front of the latch bar is formed with a rectangular projection 43 positioned oppositely to the cover's indent 10 and this projection assists in the formation of the passageways 15 by bulging inwardly the back wall of the dispenser bag as shown by FIG. 8. This rectangular projection cannot tear the bag which is suspended by the latch bar itself and moves up and down with the latch bar, the smoothly rounded inside of the indent 10 preventing damage to the bag on its other side. During latching and unlatching the vertical motion of the bag is of small extent.

The portion of the cover extending over the shelf 6 and the forwardly folded dispensing portion of the bag, has a rectangular opening 44 fitted by a correspondingly shaped push button or dispenser valve actuator 45. This push button is in the form of a lever having an inner end pivoted at 46 by way of arms 47 formed by the fixture's cover. A metal spring 48 biases the push button 45 upwardly. A tubular projection 49 is positioned so that when the cover is closed the projection substantially registers with the elastically deflectable dome 23 so as to encircle the dome's central hole 24, as shown by FIG. 6. At this time the hole 24 is not closed and the liquid in the dispenser bag can flow into and fill the metering space beneath the dome. When the push button is pressed downwardly its tubular projection 49 presses the upper wall of the bag's forwardly folded dispensing portion downwardly on the valve's dome 23 via the upper wall 19 of the bag's dispensing portion. This wall closes the hole 24 and depresses the valve's dome 23, resulting in the dispensing through the then opening check valve 22. The bottom end of the projection 49 can be formed at a small angle if required to prevent it from collapsing the dome 23 excessively.

The bracket, latch bar, cover and push button can each be made entirely as a single plastic injection molding.

What is claimed is:

1. A wall fixture containing a liquid dispenser, the fixture comprising a bracket having an upstanding plate from the bottom of which a shelf having a nozzle hole extends forwardly and a cover adapted to open and close in front of the plate and shelf, the dispenser comprising an extremely flexible bag having front and back walls, having edges side-seamed together and containing the liquid and having a main portion with its back wall suspended in front of the plate and a dispensing portion folded forwardly on the shelf so as to form a lower wall, the lower wall having a dispensing valve having a dispensing nozzle extending downwardly through said nozzle hole, and a depressible upper wall above the valve, the valve having an operator between the upper and lower walls and actuated by pressing the upper wall downwardly on the operator; said cover having pressing means for pressing a bulge in the bag's front wall at a position spaced from at least one of its side edges, and extending towards the bag's back wall at a position above said dispensing portion and so as to form a passageway on at least one side of the bulge extending between the main and dispensing portions of the bag when the cover is closed, the bulge preventing forward sagging of the bag's front wall from closing communication between the bag's main and dispensing portions.

2. The fixture of claim 1 in which said pressing means comprises said cover being formed with a wall covering the suspended bag's front wall and having an indent which presses into the front wall.

3. A wall fixture containing a liquid dispenser, the fixture comprising a bracket having an upstanding plate from the bottom of which a shelf having a nozzle hole extends forwardly and a cover adapted to open and close in front of the plate and shelf, the dispenser comprising an extremely flexible bag having front and back walls having edges side-seamed together and containing the liquid and having a main portion with its back wall suspended in front of the plate and a dispensing portion folded forwardly on the shelf so as to form a lower wall, the lower wall having a dispensing valve having a dispensing nozzle extending downwardly through said nozzle hole, and a depressible upper wall above the valve, the valve having an operator between the upper and lower walls and actuated by pressing the upper wall downwardly on the operator, said cover having a pressing means for pressing a bulge in the bag's said upper wall to actuate the operator of the valve, said dispensing nozzle and nozzle hole being shaped to form an interfitting key and key hole respectively so as to prevent an otherwise shaped dispensing nozzle of another but otherwise corresponding liquid dispenser from being contained operatively by the fixture.

4. The fixture of claim 3 in which said dispensing nozzle and nozzle have slidably interfitting cylindrical shapes one of which has an axially extending rib and the other of which has an axially extending groove in which the rib slidably fits.

5. A wall fixture containing a liquid dispenser, the fixture comprising a bracket having an upstanding plate from the bottom of which a shelf having a nozzle hole extends forwardly and a cover adapted to open and close in front of the plate and shelf, the dispenser comprising an extremely flexible bag having front and back walls having edges side-seamed together and containing the liquid and having a main portion with its back wall suspended in front of the plate and a dispensing portion folded forwardly on the shelf so as to form a lower wall, the lower wall having a dispensing valve having a dispensing nozzle extending downwardly through said nozzle hole, and a depressible upper wall above the valve, the valve having an operator between the upper and lower walls and actuated by pressing the upper wall downwardly on the operator; said cover having pressing means for pressing a bulge in the bag's front wall at a position spaced from at least one of its side edges, and extending towards the bag's back wall at a position above said dispensing portion and so as to form a passageway on at least one side of the bulge extending between the main and dispensing portions of the bag when the cover is closed, the bulge preventing forward sagging of the bags front wall from closing communication between the bag's main and dispensing portions, and in which the cover is hinged to the front end of the bracket's shelf so to swing forwardly and downwardly and give free access to the bracket's upstanding plate and shelf, the bracket's upstanding plate being flat and having a vertically slidable flat latch bar mounted on the plate behind the back wall of the bag's main portion, the latch bar having its top forming a cross head with forwardly projecting pins and the bag's top having holes through which the pins extend so as to suspend the bag's main portion on the bracket's plate, the latch bar having a bottom end projecting through a hole in the bracket's shelf and shaped for engagement by a person's finger, the latch bar having a top forming a latch for normally holding the cover closed.

6. The fixture of claim 5 in which said latch bar forms oppositely extending cantilever spring arms and the bracket's plate has means for engaging the ends of the arms at their bottom so as to cause the latch bar to be spring-biased upwardly to a latching position with the cover, the latch bar being an integral plastic injection molding.

7. The fixture of claim 6 in which the bracket's shelf has an inclined portion extending towards and to said upstanding plate and the hole through which the latch bag's bottom end projects, the bracket having depending side walls adapted to conceal the latch bar's bottom end from horizontal viewing.

8. A wall fixture containing a liquid dispenser, the fixture comprising a bracket having an upstanding plate from the bottom of which a shelf having a nozzle hole extends forwardly and a cover adapted to open and close in front of the plate and shelf, the dispenser comprising an extremely flexible bag having front and back walls having edges side-seamed together and containing the liquid and having a main portion with its back wall suspended in front of the plate and a dispensing portion folded forwardly on the shelf so as to form a lower wall, the lower wall having a dispensing valve having a dispensing nozzle extending downwardly through said nozzle hole, and a depressible upper wall above the valve, the valve having an operator between the upper and lower walls and actuated by pressing the upper wall downwardly on the operator; said cover having pressing means for pressing a bulge in the bag's front wall at a position spaced from at least one of its side edges, and extending towards the bag's back wall at a position above said dispensing portion and so as to form a passageway on at least one side of the bulge extending between the main and dispensing portions of the bag when the cover is closed, the buldge preventing forward sagging of the bags front wall from closing communication between the bag's main and dispensing portions, in which the dispensing valve's said operator is in the form of an elastically depressible dome having a central hole on which the upper wall of the bag's dispensing portion is pressed so as to seal this central hole and depress the dome to operate the valve, the cover having a forwardly extended portion covering the bag's forwardly folded dispensing portion and an opening being formed in this forwardly extended portion, the cover having a push button assembly pivoted to the inside of its said forwardly extended portion so as to swing towards and from said dome and having a downwardly extending tubular element position to register with and encircle an area of the upper wall of the bag's dispensing portion when the assembly is pushed downwardly, said area being above the dome's hole.

* * * * *